United States Patent [19]

Lee et al.

[11] Patent Number: 4,937,926

[45] Date of Patent: Jul. 3, 1990

[54] METHOD FOR MANUFACTURING LOOM BEAMS FOR WOVEN FABRICS AND AN APPARATUS THEREFOR

[75] Inventors: Kwang H. Lee; Han S. Lee, both of Seoul; Du H. Lee, Woolsan; Yong H. Kim, Daeku, all of Rep. of Korea

[73] Assignee: Tong Yang Polyester Co., Ltd., Seoul, Rep. of Korea

[21] Appl. No.: 348,801

[22] Filed: May 8, 1989

[30] Foreign Application Priority Data

Jun. 16, 1988 [KR] Rep. of Korea ..... 88-7235

[51] Int. Cl.[5] ..... D02H 9/02; D02H 5/02

[52] U.S. Cl. ..... 28/191; 139/101

[58] Field of Search ..... 28/172, 182, 184, 190, 28/191, 194; 139/7, 101, 102, 103; 242/117, 118.4

[56] References Cited

U.S. PATENT DOCUMENTS 138,391 4/1873 Galtren et al. ..... 139/101

3,534,779 4/1968 Matouch et al. ..... 28/190 X 3,853,287 12/1974 Scholze et al. ..... 139/101

4,318,428 3/1982 Seifert ..... 242/117 X

FOREIGN PATENT DOCUMENTS 3310887 9/1983 Fed. Rep. of Germany ..... 242/117

*Primary Examiner*—Werner H. Schroeder

*Assistant Examiner*—Bradley Kurtz DeSandro

*Attorney, Agent, or Firm*—Merchant, Gould, Smith, Edell, Welter & Schmidt

[57] ABSTRACT

A method for manufacturing loom beams for woven fabrics comprising the step of preparing a dividable warper beam which has the form of dividing a conventional single large warper beam into a plurality of divisional warper beams each having a uniform or non-uniform width and the step of using properly these beams together with the single large warper beams to utilize the maximum content of creel at a sizing or warping machine so that the generation of residual yarns can be minimized.

6 Claims, 4 Drawing Sheets

FIG. 4A
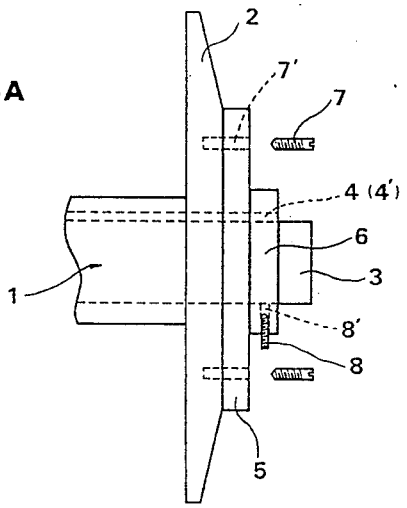
FIG. 4B
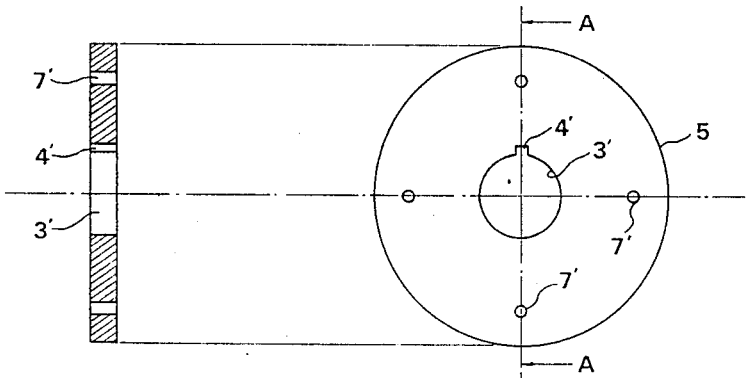
FIG. 4D
FIG. 4C
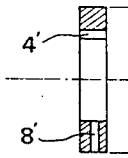
FIG. 4E
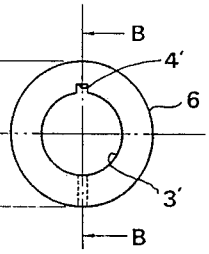

METHOD FOR MANUFACTURING LOOM BEAMS FOR WOVEN FABRICS AND AN APPARATUS THEREFOR

BACKGROUND OF THE INVENTION

The present invention relates to a method for manufacturing loom beams for woven fabrics and an apparatus therefor. Several conventional methods for producing loom beams for woven fabrics by beam warping are known. For example, loom beams are made by beaming a certain number of warper's beams prepared by warping, creel to beam sizing, or beam to beam sizing. These conventional methods may provide efficient productivity in the case of a fabric having a particular (certain) number of ends. However, except for these cases, generally the productivity is considerably decreased, because the maximum capacity of a warping or sizing machine cannot be used due to the restriction of the specification of fabric, that is, the total number of ends.

Furthermore, with the prior art method and apparatus the work stoppage time (idle time of machine) increases as the frequency of changing the warp yarns on creel increases, which is attributed to the change of specifications of fabrics. Also with the prior art method and apparatus the amount of residual short yarns and non-uniform yarns is increased unavoidably, since there remain some yarns on creel not fully used due to the change of the number of yarns wound into beam.

For example, when loom beams for a woven fabric having the total number of ends of 5,600 have to be manufactured in a sizing machine having 1,400 creels, the number of yarns which has to be provided on the creel is 1,400 (that is, 5,600 ends÷4 warper=1,400 yarns). Accordingly, the capacity of the sizing machine is utilized at 100%.

However, in the case of manufacturing the warp yarns for a fabric having a total number of ends at 5,800, the required number of yarns provided on the creel is 1,161 (that is 5,800 ends÷5 warpers), thereby causing 240 yarns on the creel to be unused (that is, 1,400 ends−1,160 yarns). This unavoidably causes a 17% decrease in productivity, in view of the fact that only 1,160 yarns among total 1,400 yarns mounted on the creels are utilized.

In the recent trends in manufacturing woven fabrics the kinds of product fabric is more various and the amount of product fabric per lot is smaller. Therefore, it is unavoidable that total ends of fabric are changed frequently. So, there is an unavoidable problem that the residual short yarns are generated in a great quantity, the time of work stoppage comes to be long, and the productivity gets decreased according to the frequent changes of the total ends of fabrics.

SUMMARY OF THE INVENTION

Therefore, an object of the present invention is to provide a novel method for manufacturing loom beams for woven fabrics and a novel apparatus therefor, which can eliminate the problems encountered in the prior art.

Another object of the present invention is to provide a novel method for manufacturing loom beams for woven fabrics, wherein the woven fabrics easily exhibit stripe effects according to different dye characteristics and different shrinking characteristics obtained by various arrangements of different kinds of warp yarns. In one respect, the present invention provides a method for manufacturing loom beams for woven fabrics by utilizing a series of works which selectively combine the steps of a creeling of yarns, a sizing or non-sizing, a separating, a warping, and a beaming, the method characterized by the steps of preparing the proper number of warper's beams by warping yarns having the number identical or close to the maximum number of yarns provided on creels, on conventional single large warper beams at sizing or warping stages; warping yarns having the number identical or close to the maximum number of yarns provided on the creels, on a dividable warper beam which has the form of dividing said single large warper beam into a plurality of divisional warper beams each having uniform or non-uniform width, in order to produce a plurality of warper's beams each having the number of yarns corresponding to the width of each corresponding divisional warper beam; and prior to the said beaming step, combining selectively the number of the prepared single large warper's beams and the number of the prepared divisional warper's beams in accordance with the total number of ends of woven fabrics to be woven so that the following equation can be satisfied:

$$E = Nm \times Cm + R$$
$$R < Cm$$
$$R = n_1R_1 + n_2R_2 + n_3R_3 \ldots$$
$$Cn = m_1R_1 + m_2R_2 + m_3R_3 \ldots$$

wherein,

E: the total number of ends of a woven fabric,

Cm: the number of warp yarns wound on a single large warper beam, which number is identical or close to the maximum number of yarns provided on creels, Cn: the total number of warp yarns wound on a plurality of dividable warper beams, which number is identical or close to the maximum number of yarns provided on creels, Nm: the number of single large warper's beams used in one beaming, R: the number of residual warp yarns generated in one beaming, which yarns are assigned by the properly selected divisional warper's beams, $R_1$, $R_2$, $R_3$ . . . : respective numbers of warp yarns wound on divisional warper beams, $m_1$, $m_2$, $m_3$ . . . : respective numbers of divisional warper beams used in one warping, and $n_1$, $n_2$, $n_3$ . . . : respective number of divisional warper's beams used in one beaming.

The present invention also provides an apparatus for manufacturing loom beams for fabrics, comprising machines which carry out a series of processes selectively combined of a creeling of yarns, a sizing or non-sizing, a separating, a warping, and a beaming, the apparatus characterized in that it includes a reed dividable into a plurality of blocks which can be interconnected, if necessary, and separated from one another to have a certain space between adjacent blocks, that said sizing or warping machine includes a conventional single large warper beam or also selectively includes a dividable warper beam which has the form of dividing said single large warper beam into a plurality of warper beams each having uniform or non-uniform width, and that the said beaming machine carries one or more said single large warper beams and the said divisional warper beam.

BRIEF DESCRIPTION OF THE DRAWINGS

Various general and specific objects and advantages of the present invention will become apparent when reference is made to the following detailed description considered in conjunction with the accompanying drawings, wherein

FIG. 4A is an exploded partial view of the outermost flange of FIG. 3B showing the mounting thereof on the shaft;

FIG. 4B is a front view of a fixing member adapted to fix the divisional warper beam to the shaft;

FIG. 4C is a sectional view of a clamping member;

FIG. 4D is a sectional view of the fixing member of FIG. 4B;

FIG. 4E is a front view of the clamping member of FIG. 4C;

DETAILED DESCRIPTION

The inventors found that since both sizing machines and warping machines include only one warper beam per shaft thereof in manufacturing loom beams for woven fabrics by using conventional beam warping, the size of the warper beam becames large. Also, since the width and the size of the said warper beams are fixed, the number of yarns provided by creels is unavoidably changed, depending upon the number of ends needed for a woven fabric. The present invention eliminates the above problems.

Figure 1:
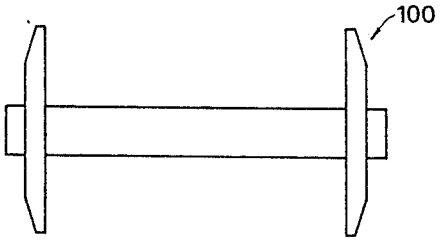
FIG. 1 ( PRIOR ART )
FIG. 1 is a front view of a conventional single warper beam.
Figure 3A:
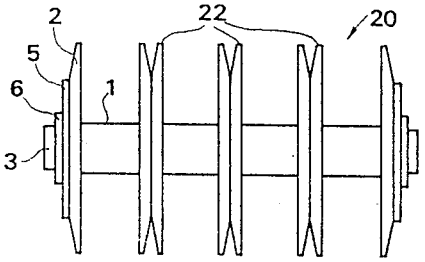
FIG. 3A is a front view showing an example of the combination of divided sectional beams having uniform width.
Figure 3B:
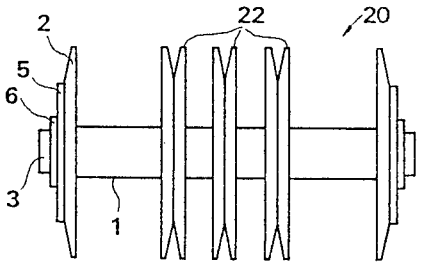
FIG. 3B is a front view showing an example of the combination of divided sectional beams having non-uniform width.

In the present apparatus, therefore, a conventional single large warper beam (100) as shown in FIG. 1 is substituted by a divisional warper beam (or divided sectional beam) which has the form of dividing the single large warper beam into a plurality of warper beams each having uniform or non-uniform width, as shown in FIGS. 3A and 3B. Conventional straight reed and zig-zag reed, which have been used in warping and sizing processes, are substituted by reeds each of which are dividable into blocks which each having a length corresponding to the width of the corresponding divisional warper beam.

Figure 2A:
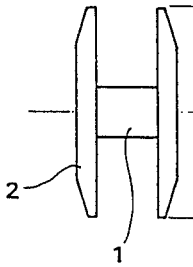
FIG. 2A is a front view of a divided sectional beam in accordance with the present invention.
Figure 2C:
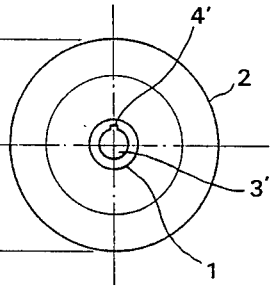
FIG. 2C is a side view of FIG. 2A.
Figure 2B:
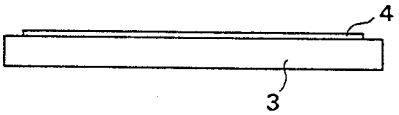
FIG. 2B is a front view of a shaft for mounting the divided sectional beams of the present invention thereon.

As shown in FIG. 2A, each divisional warper beam (divided sectional beam) in accordance with the present invention comprises a barrel (1) and a pair of flanges (2) integrally formed with the said barrel, respectively. Along the longitudinal axis of the warper beam, as shown in FIGS. 2B and 2C, a hole (3') and key groove (4') extend, in which a shaft (3) for divisional warper beams and a key (4) formed on said shaft (3) are fitted, respectively.

A plurality (20) of divisional warper beams (22) with uniform or non-uniform width can be fixedly mounted on the shaft (3), as shown in FIGS. 3A and 3B. At each of outermost flanges of the warper beams mounted on the shaft (3), a fixing member (5) and a clamping member (6) are mounted on the shaft (3), in order to prevent any movements of the warper beam along the shaft (3) during the warping or sizing process. As shown in FIGS. 4A to 4C, each fixing member (5) is connected to each outermost flange of the warper beams by means of fixing bolts (7), each of which extends through a hole (7') formed at the said fixing member.

Figure 6A:
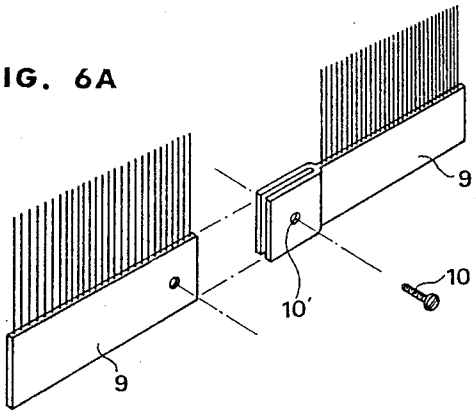
FIG. 6A is a perspective view of the dividable straight reed in accordance with the present invention.
Figure 6B:
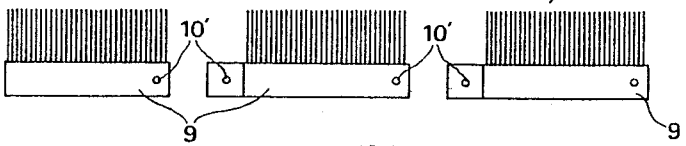
FIG. 6B is a front view of the dividable straight reed shown in FIG. 6A.
Figure 6C:
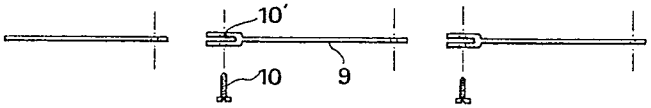
FIG. 6C is a plan view of the dividable straight reed which is under separated condition.
Figure 6D:
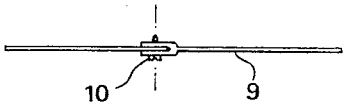
FIG. 6D is a plan view of the dividable straight reed which is under connected condition.

Each clamping member (6) is clamped upon the shaft (3) by means of a clamping bolt (8) which extends through a hole (8') formed at the said clamping member. Referring to FIGS. 6A to 6D, a dividable straight reed (9) in accordance with the present invention is shown. The reed (9) comprises a plurality of blocks (24) each having a preselected length. Each block has reed beams arranged at uniform widths, throughout the length thereof. Blocks can be connected with one another by means of bolts (10) and holes (10') formed at respective blocks to receive the said bolts. By this connection, the reed (9) has a series of reed beams, as shown in FIG. 6D. The blocks also can be separated from one another by removing the bolts (10) from the holes (10'), as shown in FIG. 6C.

Figure 5:
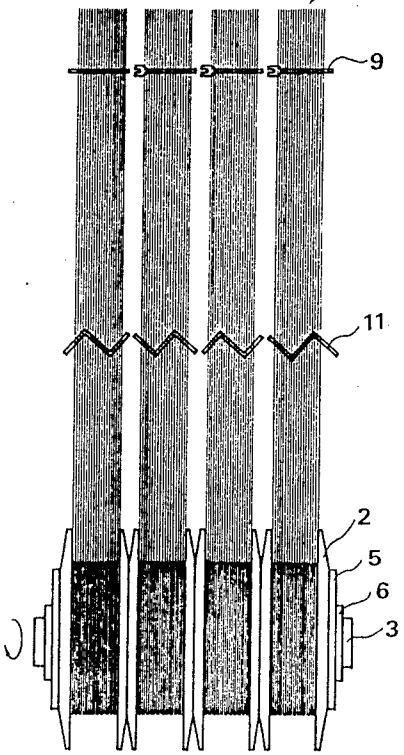
FIG. 5 is a plan view showing the condition that windings of respective divisional warper beams are carried out in parallel by means of dividable straight reeds and zig-zag reeds.

The length of each reed block to be used is selected to correspond to that of each divisional warper beam (28) as shown in FIG. 5. It is a remarkable character in the present invention that one or more divisional warper beams mounted on a common shaft on which separable weight device are attached, is capable of working with a plurality of conventional single large warper beams at a beaming process.

Figure 7A:
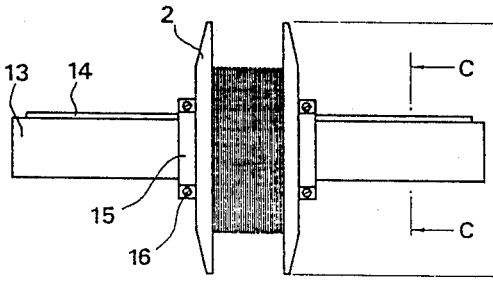
FIGS. 7A and 7B are front and side views, respectively, showing a divisional warper's beam of the present invention fixed to the beaming shaft.
Figure 7B:
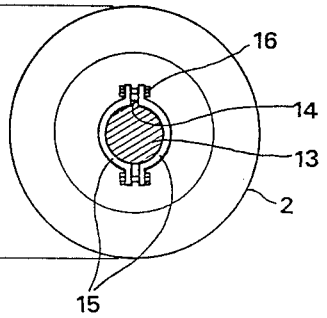
Figure 8A:
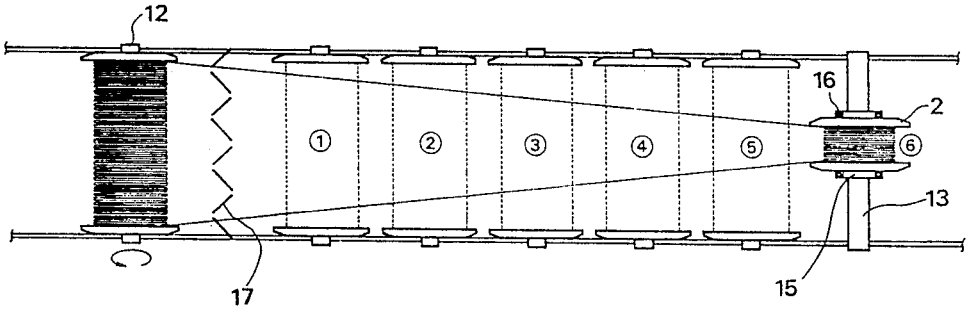
FIG. 8A is a plan view showing the mounting condition of the divisional warper beam in a beaming work.
Figure 8B:
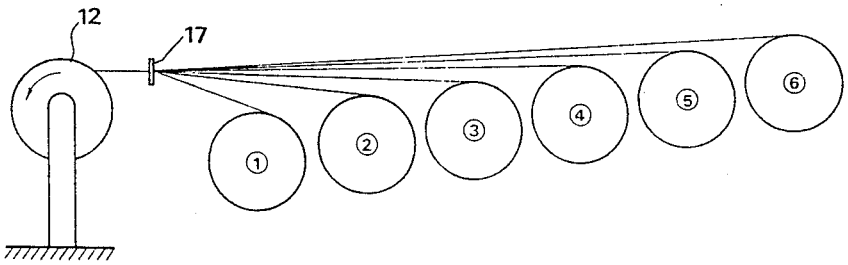
FIG. 8B is a front view showing a beaming work utilizing the divisional warper beam.

That is, one or more divisional warper beams on which yarns are wound are fitted around a beaming shaft (13), as shown in FIGS. 7A and 7B. These warper beams are disposed parallel to a plurality of conventional single large warper beams, at the beaming station, as shown in FIGS. 8A and 8B. In order to control the beaming tension of the divisional warper beams, one or more separable weight devices (15) are disposed around the beaming shaft (13).

Now, a novel method for manufacturing loom beams for woven fabrics by using the above-mentioned apparatus will be described in detail. From the analysis of conventional sizing or warping processes, the following equation can be obtained.

$$E = N \times C$$
$$C \leqq C_M$$

wherein,

E is the total number of warp yarns of a woven fabric, $C_M$ the maximum number of yarns provided on creels in sizing or warping station, C the number of actually used yarns on the creels in sizing or warping, and N the number of single large warper beams on which the number C of yarns are wound.

According to the conventional method, the total number E of ends of the woven fabric is determined first. Then, the determined total number E of ends is divided by the maximum number CM of yarns provided on creels in sizing or warping stations. The obtained value is determined as the number N of warper beams. Then, the decimal fraction of the value is counted as a unit so that the value can be counted as a natural number. The number C of actually operable yarns on the creels is calculated from the modified equation C=E/N.

Accordingly, in woven fabrics of the particular specification in which C is identical to CM, the rate of operation of the creels can be 100%. However, when C is less than CM, as happens in many cases, the rate of operation of the creel may be only C/CM×100%. The above-mentioned problems encountered in the prior art can be effectively eliminated by providing a method for manufacturing loom beams for woven fabrics by the present invention, utilizing a series of works which selectively combine the steps of a creeling of yarns, a sizing or non-sizing, a separating, a warping, and a beaming. A method is characterized by the steps of preparing the proper number of warper's beams by warping yarns having the number identical or close to the maximum number of yarns provided on creels on conventional single large warper beams in sizing or warping steps; warping yarns having the number identical or close to the maximum number of yarns provided on the creels, on a dividable warper beam which has the form of dividing each of said single large warper beams into a plurality of divisional warper beams each having uniform or non-uniform width, in order to produce a plurality of warper's beams each having the number of yarns corresponding to the width of each corresponding divisional warper beam; and prior to the said beaming step, combining selectively the number of the prepared single large warper's beams and the number of the prepared divisional warper's beams in accordance with the total number of warp yarns of a woven fabrics to be woven so that the following equation can be satisfied.

$$E = Nm \times Cm + R$$
$$R < Cm$$
$$R = n_1R_1 + n_2R_2 + n_3R_3 \ldots$$
$$Cn = m_1R_1 + m_2R_2 + m_3R_3 \ldots$$

According to the method of the present invention, the total number E of ends of the woven fabric is determined first. Then, the determined total number E of ends is divided by the number Cm identical or close to the maximum number of yarns provided on creels in sizing or warping stations. The obtained value is determined as the number Nm of single large warper beams. Then, the decimal fraction of the value is absolutely left so that the value has become a natural number. Thereafter, the number R of residual warp yarns is calculated from a modified equation $R=E-Nm\times Cm$.

The calculated number of residual warp yarns is applied to the equation $R=n_1R_1+n_2R_2+n_3R_3 \ldots$, in order to seek numbers $R_1, R_2, R_3 \ldots$ of yarns wound on respective divisional warper beams. The natural numbers $n_1, n_2, n_3 \ldots$ indicate respective numbers of divisional warper beams to be used. At this time, the numbers $R_1, R_2, R_3 \ldots$ are finally selected such that when these numbers are applied to the equation $Cn=m_1R_1+m_2R_2+m_3R_3 \ldots$, the calculated value Cn is identical or close to the value Cm and also the $m_1, m_2, m_3 \ldots$ indicate natural numbers.

The order of practicing the method as above-mentioned is as follows: First, the number of yarns identical or close to the naximum number Cm of yarns provided on creels is wound on each Nm single large warper beam. Depending upon the required amount of products, required multiples of Nm warper beams are prepared. Thereafter, respective numbers $m_1, m_2, m_3 \ldots$ of divisional warper beams which have planned numbers of yarns $R_1, R_2, R_3 \ldots$, respectively, are mounted on a warping shaft, in order to produce respective numbers $m_1, m_2, m_3 \ldots$ of warper beams which have numbers of yarns $R_1, R_2, R_3 \ldots$, respectively.

It should be noted that the sum of $m_1R_1+m_2R_2+m_3R_3 \ldots$ is identical to Cn. Depending upon the required amount of products, required multiples of respective numbers $m_1, m_2, m_3 \ldots$ of divisional warper's beams are prepared. Prior to a beaming work, respective numbers $n_1, n_2, n_3 \ldots$ of divisional warper beams to be used are properly selected so that both equations $R=n_1R_1+n_2R_2+n_3R_3 \ldots$ and $E=Nm\times Cm+R$ are satisfied. It is then important that after consideration of respective numbers of warp yarns of various woven fabrics to be produced, the values $R_1, R_2, R_3 \ldots$ and $m_1, m_2, m_3 \ldots$ are determined at one time.

Proper design and combination of divisional warper beams a each having uniform or non-uniform width a is important in improving productivity. The principles of this design and combination have been described, as above. It is also important that in order to conveniently carry out a series of works, to provide the maximum productivity, and to greater reduce residual short yarns, the kind and number of beams has to be as small as possible and the number Cn of yarns to be actually used at creels has to be identical or close to the maximum number Cm of yarns provided on creels.

It is also important to use a straight reed which can be divided into blocks, as shown in FIGS. 6A to 6D, in order to effectively carry out the warping for divisional warper beams each having uniform or non-uniform width. In warping conventional single large warper beams, the reed is used under the connected condition. However, the reed is used under the separated condition when warping for dividable warper beams.

The beaming work in accordance with the present invention has a particular characteristic. That is, the beaming shaft (13) carries the divisional warper beam ⑥ according to the present invention as well as the conventional single large warper beam ① to ⑤ as shown in FIGS. 8A and 8B.

In particular, one or more divisional warper beams are mounted on the beaming shaft (13), depending on the total number of ends which is determined by the specification of the woven fabric.

It is also important that since the beaming tension of each divisional warper beam is relatively decreased due to the light weight thereof, one or more weight devices (15) shown in FIGS. 7A and 7B are properly used. It is also important to uniformly distribute warp yarns of divisional warper beams over the width of the loom beam (12) for woven fabrics. As a result of experimentation, it was found, for example, that in the case of 5 dividable warper beams each having uniform width (that is, $m_1=5$), the proper method for taking yarns in the zig-zag reed (17) for a beaming work is: 1 in−4 out in the case of one divisional warper beam ($n_1=1$), 1 in−1 out plus 1 in−2 out in the case of two divisional warper beams ($n_1=2$), 2 in−1 out plus 1 in−1 out in the case of three divisional warper beams ($n_1=3$), and 4 in−1 out in the case of four divisional warper beams ($n_1=4$).

The present invention also provides a method for effectively producing stripe-patterned woven fabrics, by virtue of the different dye characteristics and the different tension characteristics. By winding other yarns having a different dye characteristic on the divisional warper beam of the present invention and beaming them to distribute, at a certain space, over the full width of loom beam, the woven fabric easily exhibits a stripe effect, after the dyeing thereof. By utilizing the above-mentioned separable weight device (15) or a conventional tension-adjusting means equipped in the beaming machine, in order to adjust the beaming tension of the divisional warper's beam of the present invention such that the tension becomes less or more than that of the yarns of the conventional single large warper beam, a non-uniform surface contour of the produced woven fabric and a stripe effect are provided due to the different tension effect.

As apparent from the above description, the present invention provides improved method and apparatus for manufacturing loom beams for woven fabrics, which maximizes the productivity in warping or sizing works, in that the machines use all the creel's yarns, even if the total number of ends is frequently changed due to the production of various kinds of woven fabrics in small quantities. In addition, the present invention avoids any increase of work stoppage time and any increase of the residual yarns caused by the frequent change of the total number of ends.

Finally, the present invention provides method and apparatus for easily manufacturing woven fabrics having a stripe effect. The present invention will be more apparent, by referring to the following description of the examples.

EXAMPLE 1

By using a sizing machine provided with the maximum number CM 1400 of creels, a work preparing warp yarns for weaving a fabric having 7200 ends is carried out as follows. First, 75 deniers polyester filaments are held in all of 1400 creels. Then, 5 sizing warper beams is prepared by using conventional single large warper beams (100) as shown in FIG. 1 and a dividable straight reed (9) which is at the connected condition as shown in FIG. 6D.

Thereafter, one set of sizing warper beams is prepared by dividing the straight reed (9) into its blocks and warping 1400 yarns on a dividable warper beam which can be divided into 7 parts at uniform width. The prepared dividable warper beam set includes 7 sizing divisional warper beams having 200 yarns.

On these single large warper beams and dividable warper beams, yarns are wound at a rate of 200 m/min., under the same conditions. At the sizing stage, a sizing work is carried out by using a 10% solution of a sizing agent which is prepared by mixing a polyacrylic acid ester and a polyvinyl alcohol at a rate of 1:1. The weight of the sizing agent which is absorbed on yarns is about 8% on the weight of fiber.

In order to produce loom beams (12), 5 single large warper beams (on each of which 1400 yarns are wound) and one divisional warper beam (on which 200 yarns are wound) are disposed in position as shown in FIG. 8A and 8B. Then, the winding tension is adjusted to 0.2 g/denier, by using weight device (15). The loom beams (12) are prepared by beaming the yarns which in the zig-zag reed (17) is taken at a full set (that is, one yarn is held in one reed beam to every warper beam) for conventional large warper beams and at one-in and six-out for the divisional warper beam.

A virtue of using the dividable warper beam, which is the method of the present invention, is that it provides a substantial increase in production as compared with the prior art in which 6 single warper beams each having 1200 yarns are used.

TABLE 1

| | Number of Yarns of Creel | Total Number of Warper Beams: Large Warper | Total Number of Warper Beams: Divisional Warper | Total Number of ends | Effect |
|---|---|---|---|---|---|
| Present Invention | 1400 | 5 | 1 | 7200 | 16.7% improved over prior art |
| Prior Art | 1200 | 6 | — | 7200 | |

EXAMPLE 2

Loom beams to be woven are prepared by using the same method as in Example 1, except that 75 denier polyester filament yarns are used as the yarns for single large warper beams and 70 denier nylon filament yarns are used as the yarns for the dividable warper beam. The fabric woven from the loom beams is dyed with a disperse dye and an acid dye. This results in a stripe effect on the fabric which may be achieved very easily.

EXAMPLE 3

By using 75 denier polyester filament yarns, 5 kinds of loom beams for fabrics which have the total number of ends of 7200, 7500, 7700, 7800, and 9000, respectively, are prepared as follows: In all cases, yarns are wound at a rate of 250 m/min. Sizing work is carried out by using a 12% solution of a sizing agent of a polyacrylic acid ester. The weight of sizing agent absorbed on the yarns is about 6.3% on the weight of fiber. In the beaming process, the yarns are wound at a rate of 150 m/min. The winding tension is 0.25 g/denier.

First, yarns are held in all of 1400 creels. Then, the sizing work is carried out on 26 sets of single large warper beams each having 1400 yarns. Thereafter, a dividable warper beam is prepared by assembling 6 divisional warper beams having a width ratio of 3:3:2:2:2:2. According to the width ratio, 1400 yarns of the total creels are proportionally distributed on the divisional warper beams, under the above sizing condition. As a result, two sets of dividable warper beams comprising 2 divisional warper beams having 300 yarns and 4 divisional warper beams having 200 yarns, are prepared.

The beaming process is carried out, depending upon the total number of ends of each fabric. For the loom beam having 7200 yarns, the beaming process is carried out, as in Example 1. In the case of the loom beam having 7500 yarns, the beaming is carried out, in a manner illustrated in FIGS. 8A and 8B, by using the combination of 5 conventional single large warper beams each having 1400 yarns and a dividable warper beam including two divisional warper beams having 200 yarns and 300 yarns respectively. At this time, the zig-zag reed (17) functions to hold yarns on the conventional single large warper beams at full set and on the dividable warper beam at one in - one out, one in - two out, one in - two out, one in - two out, and one in - two out, in order to uniformly distribute the yarns to the loom beam (12).

In the case of the loom beam having 7700 yarns, the combination of 5 conventional single large warper beams each having 1400 yarns and a dividable warper beam including one divisional warper beam having 300 yarns and two divisional warper beams each having 200 yarns is used. By the zig-zag reed, the dividable warper beam is subject to a beaming at one in - one out. In the case of the loom beam having 7800 yarns, the combination of 5 single large warper beams each having 1400 yarns and a dividable warper beam including two divisional warper beams each having 300 yarns and one divisional warper beam having 200 yarns is used. The dividable warper beam is subject to a beaming at one in - one out, one in - one and two in - one out.

For the loom beam having 9000 yarns, the combination of 6 single large warper beams each having 1400 yarns and a dividable warper beam including three divisional warper beams each having 200 yarns is used. The dividable warper beam is subject to a beaming at one in - one out, one in - one out, and one in - two out, while the yarns are held in the zig-zag reed. In this example, all of the above warper beams can be produced by 28 times of sizing works each of which uses all of the 1400 yarns provided at the creel.

On the other hand, prior art requires 33 times the sizing work each of which uses different number of yarns provided at the creel. Therefore, the present invention provides a 17.9% improvement in productivity over the prior art by virtue of maximum use of the yarns provided at the creel. Although the number of yarns provided at the creel has to be varied for each loom beam in the prior art, since the number of the used yarns is 1200, 1250, 1100, 1300, and 1125 for the above cases, such variation of the number of yarns used is unnecessary in the present invention, by virtue of the use of the dividable warper beam. As a result, it is also possible to reduce labor and time.

TABLE 2

| | Number of Yarns of Creel | Total Number of Warper Beams: Large Waper | Divisional Warper Having 300 Yarns | Divisional Warper Having 200 Yarns | Total Number of ends | Effect |
|---|---|---|---|---|---|---|
| Present Invention | 1400 | 5 | — | 1 | 7200 | 1. 17.9% of productivity is increased by utilizing a maximum number of yarns on the creels |
| | 1400 | 5 | 1 | 1 | 7500 | |
| | 1400 | 5 | 1 | 2 | 7700 | |
| | 1400 | 5 | 2 | 1 | 7800 | |
| | 1400 | 6 | — | 3 | 9000 | |
| Prior Art | 1200 | 6 | — | — | 7200 | 2. The time and labor are saved by virtue of not having to change the number of yarns on the creels |
| | 1250 | 6 | — | — | 7500 | |
| | 1100 | 7 | — | — | 7700 | |
| | 1300 | 6 | — | — | 7800 | |
| | 1125 | 8 | — | — | 9000 | 3. No residual yarns and non-uniform yarns are produced. |

What is claimed is:

1. A method for manufacturing loom beams for woven fabrics by utilizing a series of works which selectively combine the steps of creeling of yarns, sizing, separating, warping, and beaming; the method comprising the steps of:

preparing the proper number of warper beams by warping yarns having the number identical or close to the maximum number of yarns provided on creels, on conventional single large warper beams at sizing or warping stages;

warping yarns having the number identical or close to the maximum number of yarns provided on the creels, on a dividable warper beam comprising a plurality of divisional warper beams each having uniform or non-uniform width, to produce a plurality of warper beams each having the number of yarns corresponding to the width of each corresponding divisional warper beam; and prior to the said beaming step, combining selectively the number of the prepared single large warper beams and the number of the prepared divisional warper beams in accordance with the total number of ends of a woven fabrics to be woven so that the following equation can be satisfied:

$$E = Nm \times Cm + R$$
$$R < Cm$$
$$R = n_1R_1 + n_2R_2 + n_3R_3$$
$$Cn = m_1R_1 + m_2R_2 + m_3R_3$$

wherein,

E: the total number of ends of a woven fabric,

Cm: the number of warp yarns wound on a single large warper beam, which number is identical or close to the maximum number of yarns provided on creels, Cn: the total number of warp yarns wound on a plurality of dividable warper beams, which number is identical or close to the maximum number of yarns provided on creel, Nm: the number of single large warper's beams used in one beaming.

R: the number of residual warp yarns generated in one beaming, which yarns are assigned by the properly selected divisional warper's beams.

$R_1$, $R_2$, $R_3$ . . . : respective numbers of warp yarns wound on divisional warper beams, $m_1$, $m_2$, $m_3$ . . . : respective numbers of divisional warper beams used in one warping, and $n_1$, $n_2$, $n_3$ . . . : respective numbers of divisional warper's beams used in one beaming.

2. A method in accordance with claim 1, wherein the dye characteristic of yarns used in said dividable warper beam is different from that of the yarns used in said single large warper beams, and these yarns are distributed at a certain space over the produced woven fabric so that, after dyeing, the woven fabric exhibits a striped effect.

3. A method in accordance with claim 1, wherein the beaming tension of said dividable warper beam is not equal to the beaming tension of said single large warper beam so that, after dyeing, the produced woven fabric exhibits particular shrinkage and dye effects.

4. An apparatus for manufacturing loom beams for fabrics, comprising machines which carry out a series of processes which selectively combine a creeling of yarns, a sizing or non-sizing, a separating, a warping, and a beaming, said apparatus including a reed dividable into a plurality of blocks which can be interconnected and separated from one another to have a certain space between adjacent blocks, and said apparatus comprising at least one conventional single large warper beam and at least one selectively includable dividable warper beam, said dividable warper beam comprising means for dividing said single large warper beam into a plurality of warper beams each having uniform or non-uniform width.

5. An apparatus in accordance with claim 4, wherein said dividable warper beam includes weight means separably mounted on a beaming shaft, said weight means being constructed and arranged for adjusting the tension of beaming.

6. An apparatus in accordance with claim 4, wherein said reed blocks have a length corresponding to the width of the corresponding divisional warper beam.

* * * * *